US007302196B2

(12) United States Patent
Nakashima

(10) Patent No.: US 7,302,196 B2
(45) Date of Patent: Nov. 27, 2007

(54) IMAGE FORMING APPARATUS, DEVELOPER TANK, AND METHOD OF IDENTIFYING DEVELOPER TANK

(75) Inventor: Ryuichi Nakashima, Nara (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 174 days.

(21) Appl. No.: 11/231,893

(22) Filed: Sep. 22, 2005

(65) Prior Publication Data

US 2006/0067715 A1 Mar. 30, 2006

(30) Foreign Application Priority Data

Sep. 24, 2004 (JP) ..... 2004-277505

(51) Int. Cl.
*G03G 15/00* (2006.01)
*G03G 15/01* (2006.01)

(52) U.S. Cl. ..... 399/12; 399/223

(58) Field of Classification Search ..... 399/12, 399/223, 9, 262, 25, 111, 110; 347/19, 49, 347/86; 324/658, 686
See application file for complete search history.

(56) References Cited

U.S. PATENT DOCUMENTS 4,662,737 A 5/1987 Ueguri
6,385,407 B1 * 5/2002 Inose ..... 399/12 X
6,490,422 B2 * 12/2002 Harumoto ..... 399/12 X

FOREIGN PATENT DOCUMENTS

| | | | |
|---|---|---|---|
| JP | 61-140961 | A | 6/1986 |
| JP | 05-254147 | A | 10/1993 |
| JP | 2002-365983 | A | 12/2002 |
| JP | 2003-005588 | A | 1/2003 |
| JP | 2003-237101 | A | 8/2003 |

* cited by examiner

*Primary Examiner*—Sophia S. Chen
(74) *Attorney, Agent, or Firm*—Birch, Stewart, Kolasch & Birch, LLP

(57) ABSTRACT

An image forming apparatus includes an image forming apparatus body, and developer tanks to be removably fitted to the body. The developer tanks each have a charging current inflow terminal which allows a charging current to flow in therefrom, and a capacitor which allows the charging current flowing in from the charging current inflow terminal to pass therethrough. The body includes a charging current outflow terminal to be connected to the charging current inflow terminal when an associated one of the developer tanks is fitted to the body, and an identifier section configured to pass the charging current to the charging current outflow terminal when the associated developer tank is fitted to the body and identify the developer tank based on a change in waveform that occurs during a transient phenomenon period during which the charging current passes through the capacitor of the developer tank.

18 Claims, 12 Drawing Sheets

FIG. 6

| HIGH-SPEED APPARATUS | | | | MEDIUM-SPEED APPARATUS | | | | LOW-SPEED APPARATUS | | | |
|---|---|---|---|---|---|---|---|---|---|---|---|
| K | Cy | M | Y | K | Cy | M | Y | K | Cy | M | Y |
| C1 | C2 | C3 | C4 | C5 | C6 | C7 | C8 | C9 | C10 | C11 | C12 |

IMAGE FORMING APPARATUS, DEVELOPER TANK, AND METHOD OF IDENTIFYING DEVELOPER TANK

CROSS REFERENCE

This Nonprovisional application claims priority under 35 U.S.C. § 119(a) on Patent Application No. 2004-277505 filed in Japan on Sep. 24, 2004, the entire contents of which are hereby incorporated by reference.

BACKGROUND OF THE INVENTION

The present invention relates to an image forming apparatus configured to identify developer tanks of different types on a model-by-model basis or on a developer color basis for a single model.

Nowadays, multifunctional and diversified image forming apparatus are progressing. Such image forming apparatus use developer tanks of different types on a model-by-model basis. Image forming apparatus of the type capable of color printing use developer tanks containing respective of black (K), yellow (Y), magenta (M) and cyan (Cy) developers. For this reason, a factory and a service department are required to pay careful attention to fitting of removable developer tanks in respective correct positions. In the present conditions where such factory and service department must handle developer tanks of many types, it is highly possible that such developer tanks are fitted erroneously.

A prior-art technique serving as a hint for a solution of this problem is configured to determine whether or not an ink-containing cartridge is fitted to an ink-jet printer based on a time constant varying according to whether or not the cartridge is fitted, as disclosed in Japanese Patent Laid-Open Publication No. H05-254147.

Another relevant prior-art technique is configured to detect fitted condition and empty condition of an ink cartridge by an arrangement wherein the ink tank is provided with electrodes and an interface circuit disposed between these electrodes, as disclosed in Japanese Patent Laid-Open Publication No. 2003-237101.

However, either of the aforementioned prior-art techniques is configured to detect the fitted state of an ink cartridge and cannot identify the type of the cartridge fitted or detect whether or not the cartridge is properly fitted in its correct position. For this reason, even if such a technique is applied to an image forming apparatus to be fitted with developer tanks of various types, a problem remains unsolved that it is not possible to detect whether or not a proper developer tank is fitted in its correct position, though it is possible to detect whether or not each of the developer tanks is fitted.

Prior-art image forming apparatus include one which has a resistance type voltage divider circuit comprising a resistive element for identification disposed at a developer tank and another resistive element disposed on the apparatus body side and connected in series with the other. With the resistance type voltage divider circuit being applied with a fixed voltage, the developer tank is identified by detection of a voltage (divided voltage) across the opposite ends of the resistive element disposed at the developer tank.

With the apparatus adapted to identify a developer tank by means of such a resistance type voltage divider circuit, however, it is difficult to identify a number of developer tanks while securing sufficient resolving power and S/N. For example, in the case where 20 types of developer tanks are to be identified and an ordinary IC of which VCC is 5V is used as a divided voltage detection circuit, detection need be conducted with a precision of 0.25V per resistive element according to a simple calculation. If a margin of allowance, variability of resistive elements, noise and a like factor are taken into consideration, correct identification of each of the developer tanks is found to be practically very difficult.

A feature of the present invention is to provide an image forming apparatus, a developer tank and a method of identifying a developer tank, each of which allows developer tanks to be identified correctly with a sufficient margin of allowance.

SUMMARY OF THE INVENTION

An image forming apparatus according to the present invention includes an image forming apparatus body, and developer tanks to be removably fitted to the image forming apparatus body. The developer tanks each have a charging current inflow terminal which allows a charging current to flow in therefrom, and a time constant circuit which allows the charging current flowing in from the charging current inflow terminal to pass therethrough. The image forming apparatus body includes a charging current outflow terminal to be connected to the charging current inflow terminal when an associated one of the developer tanks is fitted to the image forming apparatus body, and an identifier section configured to pass the charging current to the charging current outflow terminal when the associated developer tank is fitted to the image forming apparatus body and identify the developer tank based on a change in waveform that occurs during a transient phenomenon period during which the charging current passes through the time constant circuit of the developer tank.

The foregoing and other features and attendant advantages of the present invention will become more apparent from the reading of the following detailed description of the invention in conjunction with the accompanying drawings.

BRIEF DESCRIPTION OF THE DRAWINGS

FIG. 6 shows types of capacitors C provided for developer tanks;

DETAILED DESCRIPTION OF THE PREFERRED EMBODIMENTS

The present invention will now be described in detail with reference to the accompanying drawings.

Figure 1:
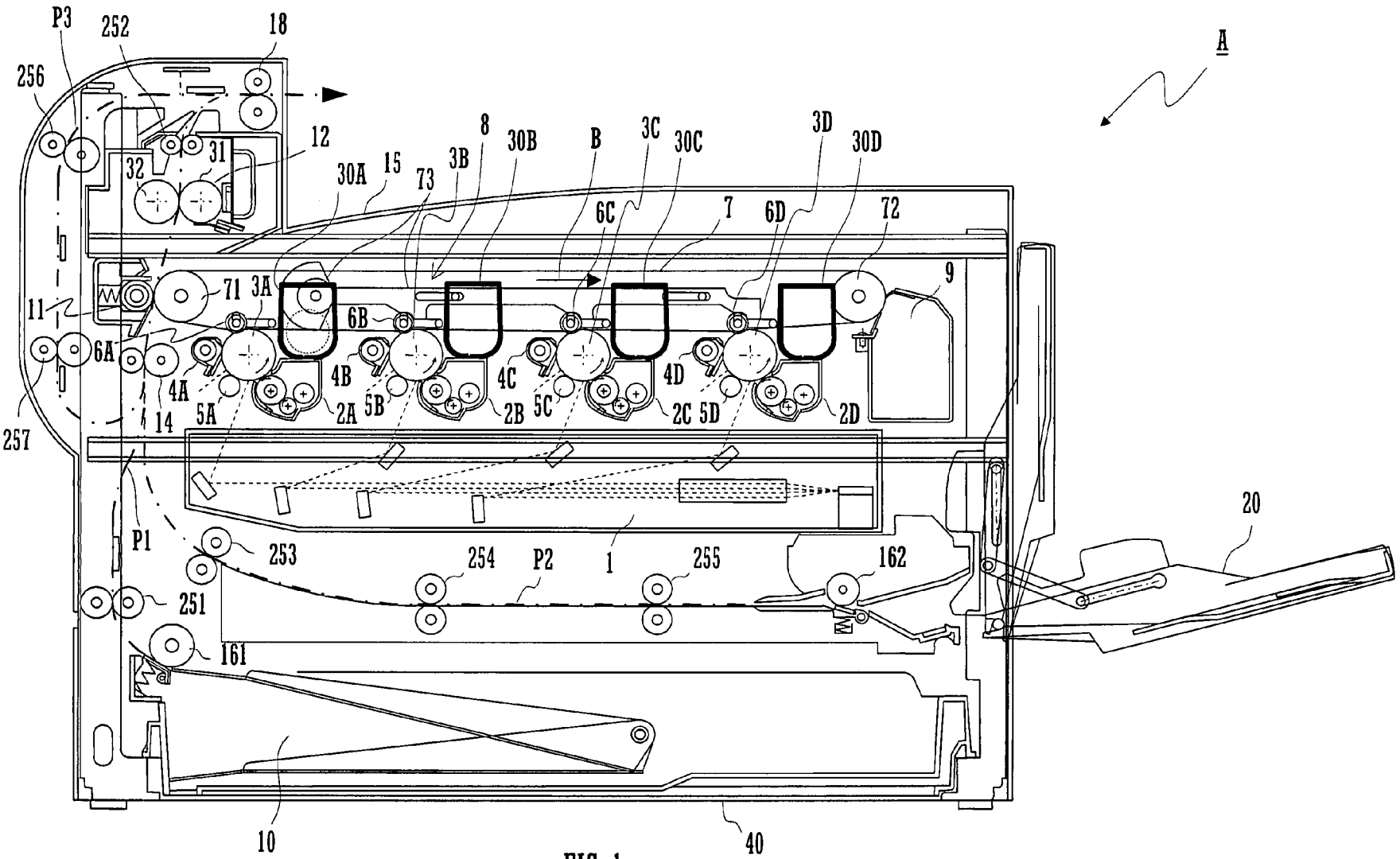
FIG. 1 is a schematic view showing the construction of an image forming apparatus according to an embodiment of the present invention.

FIG. 1 is a schematic view showing the construction of an image forming apparatus according to an embodiment of the present invention. Image forming apparatus A according to this embodiment is a color image forming apparatus capable of color image formation by the use of black (K), cyan (Cy), magenta (M) and yellow (Y) developers (toners). This image forming apparatus A is provided with developer tanks 30A to 30D which are removably fitted to image forming apparatus body 40 by means of a non-illustrated known fitting-removing device.

In this embodiment the developer tanks 30A, 30B, 30C and 30D contain black (K) developer, cyan (Cy) developer, magenta (M) developer and yellow (Y) developer, respectively. The developer tanks 30A to 30D have the same shape. In an image forming apparatus of other type than shown in FIG. 1, the developer tanks 30A to 30D are different in shape and the developers contained in respective of the developer tanks 30A to 30D are different from each other in characteristics. If there are three types of image forming apparatus such as for example, high-speed type apparatus, medium-speed type apparatus and low-speed type apparatus, developer tanks 30A to 30D for use in one of these three types of image forming apparatus are different in tank shape and developer (toner) characteristics from those for use in another. In this case, therefore, 12 (=4×3) types of developer tanks need be provided as developer tanks 30A to 30B. Thus, specific developer tanks 30A to 30D are fitted in respective specific positions in an image forming apparatus on a type-by-type (high-speed type, medium-speed type and low-speed type) basis and on a color-by-color basis.

The present image forming apparatus A includes exposure unit 1, developing devices 2A to 2D, photosensitive drums 3A to 3D, static chargers 5A to 5D, cleaner units 4A to 4D, intermediate transfer belt unit 8, fixing unit 12, sheet feed paths P1 to P3, sheet feed tray 10, ejected sheet tray 15, and other components.

The image forming apparatus A performs image formation using image data items corresponding to four colors, i.e., black (K), cyan (Cy), magenta (M) and yellow (Y), as described above. Four developing devices 2A to 2D, four photosensitive drums 3A to 3D, four static chargers 5A to 5D, and four cleaner units 4A to 4D are provided to form four image stations for forming four latent images each corresponding to a respective one of the four colors.

The photosensitive drums 3A to 3D are disposed (or mounted) in an upper portion of the image forming apparatus A.

Each of the static chargers 5A to 5D is electrostatic charger means for electrostatically charging the surface of a respective one of the photosensitive drums 3A to 3D to a predetermined potential uniformly, and comprises a contact-type charger roller as shown in FIG. 1. Instead of the charger roller, it is possible to use a brush-type charger or a non-contact type charger device.

The exposure unit 1 comprises a laser scanning unit (LSU) including a laser light emitting section and a reflecting mirror as shown in FIG. 1. Alternatively, the exposure unit 1 may employ, for example, an EL or LED write head comprising an array of light-emitting devices. The exposure unit 1 exposes charged photosensitive drums 3A to 3D to light according to image data items inputted to form latent images on respective photosensitive drums 3A to 3D based on the image data items.

The developing devices 2A to 2D develop the latent images formed on respective photosensitive drums 3A to 3D into visible images by the use of black (K) toner, cyan (Cy) toner, magenta (M) toner and yellow (Y) toner.

Each of the cleaner units 4A to 4D removes and collects residual toner which remains on the surface of the associated one of the photosensitive drums 3A to 3D after the development and transfer process has been completed.

The intermediate transfer belt unit 8 extending above the photosensitive drums 3A to 3D includes an intermediate transfer belt 7, intermediate transfer belt driving roller 71, intermediate transfer belt tension mechanism 73, intermediate transfer belt driven roller 72, intermediate transfer rollers 6A to 6D, and intermediate transfer belt cleaning unit 9.

The intermediate transfer belt driving roller 71, intermediate transfer belt tension roller 73, intermediate transfer rollers 6A to 6D, intermediate transfer belt driven roller 72 and the like entrain the intermediate transfer belt 7 thereabout and drives the intermediate transfer belt 7 to revolve in the direction indicated by arrow B.

The intermediate transfer rollers 6A to 6D, each of which is rotatably supported by an intermediate transfer roller mounting portion of the intermediate transfer belt tension mechanism 73, apply transfer bias for transferring the toner images from the photosensitive drums 3A to 3D to the intermediate transfer belt 7.

The intermediate transfer belt 7 is positioned to contact the photosensitive drums 3A to 3D of respective image stations. Toner images in respective colors formed on the photosensitive drums 3A to 3D are transferred to the intermediate transfer belt 7 so as to be superimposed one upon another sequentially, thereby forming a color toner image (multi-color toner image) on the intermediate transfer belt 7. The intermediate transfer belt 7 comprises an endless film having a thickness of about 100 to about 150 μm.

Transfer of toner images from the photosensitive drums 3A to 3D to the intermediate transfer belt 7 is achieved by means of the intermediate transfer rollers 6A to 6D contacting the reverse side of the intermediate transfer belt 7. The intermediate transfer rollers 6A to 6D are each applied with a high-voltage transfer bias of polarity (×) opposite to polarity (−) of electrostatically charged toner. The intermediate transfer rollers 6A to 6D each comprise a metal shaft (of stainless steel for example) having a diameter of 8 to 10 mm and an electrically conductive resilient member (of EPDM or foamed urethane for example) covering the surface of the metal shaft. The intermediate transfer belt 7 can be uniformly applied with a high voltage through the electrically conductive resilient member. This embodiment uses a roller-shaped transfer electrode; however, it is possible to use a brush-type transfer electrode or a transfer electrode of any other type.

As described above, the images developed into visible images in respective colors on respective of the photosensitive drums 3A to 3D are superimposed one upon another on the intermediate transfer belt 7. The resulting superimposed image is transported by revolution of the intermediate transfer belt 7 and then transferred to a recording sheet by means of a transfer roller 11 located at a position where the recording sheet is brought into contact with the intermediate transfer belt 7. At that time, the intermediate transfer belt 7 and the transfer roller 11 are pressed against each other at a predetermined nip pressure, while the transfer roller 11 applied with a high voltage of the polarity (+) opposite to the polarity (−) of charged toner for the toner to be transferred to the recording sheet. For the nip pressure to be steadily obtained, one of the transfer roller 11 and the intermediate transfer belt driving roller 71 is formed of a hard material (such as a metal), while the other formed of a soft material such as a resilient roller (for example resilient rubber roller or foamed resin roller).

Toner attached to the intermediate transfer belt 7 from the photosensitive drums 3A to 3D as described above or toner that remains on the intermediate transfer belt 7 without having been transferred to the recording sheet by the transfer roller 11 is removed and collected by the intermediate transfer belt cleaning unit 9 to avoid color mixture in the succeeding process. The intermediate transfer belt cleaning unit 9 includes a cleaning member contacting the intermediate transfer belt 7. The cleaning member comprises a cleaning blade for example. The intermediate transfer belt 7 in a state contacted by this cleaning blade is supported on the intermediate transfer belt driven roller 72 from the reverse side.

The sheet feed tray 10 is a tray for stacking sheets (recording sheets) to be used in image formation and is positioned below the image forming section and exposure unit 1 of the image forming apparatus A. The ejected sheet tray 15 disposed in an upper portion of the image forming apparatus A is configured to receive each printed sheet thereon with its face down.

The image forming apparatus A defines sheet feed paths P1 to P3 for feeding each of the recording sheets held on the sheet feed tray 10 to the ejected sheet tray 15 via the transfer section 11 and the fixing unit 12. Along the sheet feed paths P1 to P3 are disposed pickup rollers 161 and 162, registration roller 14, transfer section 11, fixing unit 12, transport rollers 251 to 257 operative to transport each of the recording sheets, ejection roller 18, and other components.

The transport rollers 251 to 257 are small-sized rollers for facilitating and assisting in sheet feeding and are disposed along the sheet feed paths P1 to P3. The pickup roller 161 is located at an end of the sheet feed tray 10 and is operative to pay out the recording sheets held in the sheet feed tray 10 onto the sheet feed path P1 one by one. Similarly, the pickup roller 162 is located at an end of a manual feed tray 20 to be described later and is operative to pay out the recording sheets held in the manual feed tray 20 onto the sheet feed path P2 one by one.

The registration roller 14 is operative to temporarily hold each recording sheet being fed on the sheet feed path P1. The registration roller 14 has the function of feeding the recording sheet to the transfer section 11 with such timing as to register the leading edge of the recording sheet with the leading edge of each of the toner images formed on the photosensitive drums 3A to 3D.

The fixing unit 12 includes a heat roller 31, a pressure roller 32 and other components. The heat roller 32 and pressure roller 32 rotate while nipping each recording sheet therebetween.

The heat roller 31 is controlled based on a signal from a non-illustrated temperature sensor so that the temperature thereof is kept at a predetermined fixing temperature. The heat roller 31 cooperates with the pressure roller 32 to subject each recording sheet to heat and pressure thereby exercising the function of fusing, mixing and pressurizing the multi-color toner image transferred to the recording sheet to thermally fix the image to the sheet.

The recording sheet bearing the multi-color image fixed thereto is transported by means of the ejection roller 18 to the sheet feed path P3, which serves as a reversed sheet ejection path. The recording sheet on the sheet feed path P3 is passed through the pickup roller 14 and the like again and then ejected in a reversed condition (with the multi-color image oriented upwardly) onto the ejected sheet tray 15.

In the image forming apparatus A there are disposed the sheet feed cassette 10 holding recording sheets pre-stored therein, and the manual feed tray 20 allowing a few sheets to be printed without the need to have the user open and close the sheet feed cassette 10. Recording sheets are guided one by one from the sheet feed cassette 10 or the manual feed tray 20 to the sheet feed path P1 or P2 by means of the pickup roller 161 or 162.

Image information is printed on a recording sheet in the following manner.

A recording sheet fed from the sheet feed cassette 10 is transported to the registration roller 14 by means of the transport roller 251 on the sheet feed path P1. The registration roller 14, in turn, feeds the recording sheet to the transfer roller 11 with such timing as to register the leading edge of the sheet with the leading edge of the image information on the intermediate transfer belt 7, so that the image information is written on the sheet. Image information is transmitted from a non-illustrated computer, terminal device or scanner through a communication line. After the image information has been written on the recording sheet, the sheet is passed through the fixing unit 12 where unfixed toner on the sheet is fused and fixed to the sheet by heat. Thereafter, the recording sheet is passed through the transport roller 252 and then ejected onto the ejected sheet tray 15 by the ejection roller 18 (in the one-side printing mode).

Alternatively, a recording sheet on the manual feed tray 20 is picked up by the pickup roller 162 and then transported on the sheet feed path P2 provided with plural transport rollers 255, 254 and 253 up to the registration roller 14. Thereafter, the recording sheet passes through the same path as does the recording sheet from the sheet feed cassette 10 and is then ejected onto the ejected sheet tray 15 (in the one-side printing mode).

In the double-side printing mode, a recording sheet which has finished with one-side printing and passed through the fixing unit 12 as described above is caught at its trailing edge by the ejection roller 18 and then fed to the sheet feed path P3 by backward rotation of the ejection roller 18. Thereafter, the transport rollers 256 and 257 on the sheet feed path P3 transport the recording sheet on the sheet feed path P3 to the registration roller 14 for reverse-side printing to be achieved. Finally, the recording sheet is ejected onto the ejected sheet tray 15.

Now, description will be made of a developer tank identifying device.

Figure 2:
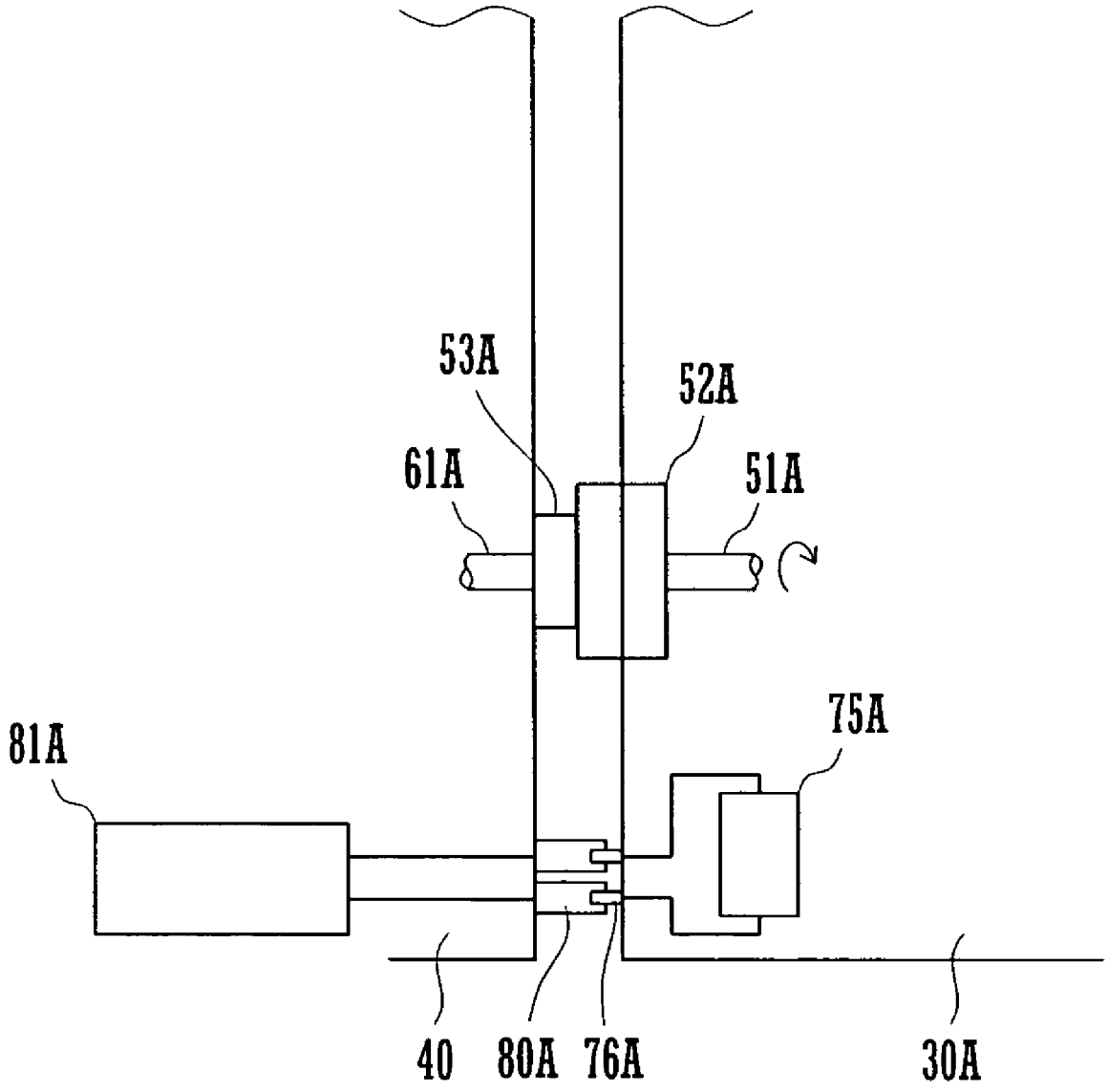
FIG. 2 illustrates a portion of the image forming apparatus in a state where developer tank is fitted to image forming apparatus body.

FIG. 2 illustrates a portion of the image forming apparatus in a state where developer tank 30A is fitted to image forming apparatus body 40. FIG. 2 is a view of a rear portion of the developer tank 30A as viewed from a lateral side of the apparatus shown in FIG. 1. The developer tank 30A can be fitted to the image forming apparatus body 40 by being slid from the front side toward the rear side of the image forming apparatus A. The developer tank 30A can be removed from the image forming apparatus body 40 by being drawn out toward the front side.

As shown in FIG. 2, when the developer tank 30A is fitted to the image forming apparatus body 40 by being pressed toward the rear side with the front panel of the image forming apparatus A open, a first engagement portion 52A of the developer tank 30A engages a second engagement portion 53A of the image forming apparatus body 40. By so doing, a rotating shaft 61A of the image forming apparatus body 40 is coupled to a rotating shaft 51A of the developer tank 30A. The rotating shaft 51A is joined with an agitating blade located within the developer tank 30A for agitating toner in the developer tank 30A.

The developer tank 30A is provided with a time constant circuit 75A comprising a capacitor circuit to be described later. The developer tank 30A has a rear side having a charging current inflow terminal 76A connected to the time constant circuit 75A. The image forming apparatus body 40 has a charging current outflow terminal 80A to be coupled to the charging current inflow terminal 76A. The charging current outflow terminal 80A is connected to an identifier section 81A. When the image forming apparatus body 40 becomes fitted with the developer tank 30A, the identifier section 81A passes a charging current to the charging current outflow terminal 80A to identify the developer tank 30A based on a change in the waveform of voltage across the opposite ends of the time constant circuit 75A which occurs during a transient phenomenon period during which the charging current passes through the time constant circuit 75A of the developer tank 30A.

Note that: developer tanks 30B to 30D each have the same configuration as the developer tank 30A.

Furthermore, there is also a second engagement portion to engage each of developer tanks 30B to 30D. Each second engagement portion to engage each developer tank 30B to 30D has the same configuration as the second engagement portion 53A.

There is also a rotating shaft corresponding to each developer tank 30B to 30D. Each rotating shaft corresponding to each developer tank 30B to 30D has the same configuration as the rotating shaft 61A.

Further, there is a charging current outflow terminal corresponding to each developer tank 30B to 30D. Each current outflow terminal corresponding to each developer tank 30B to 30D has the same configuration as the charging current outflow terminal 80A.

Likewise, there is an identifier section corresponding to each developer tank 30B to 30D. Each identifier section corresponding to each developer tank 30B to 30D has the same configuration as the identifier section 81A.

In this embodiment, the time constant circuit 75A and each time constant circuit corresponding to each developer tank 30B to 30D comprises a capacitor circuit.

Figure 3:
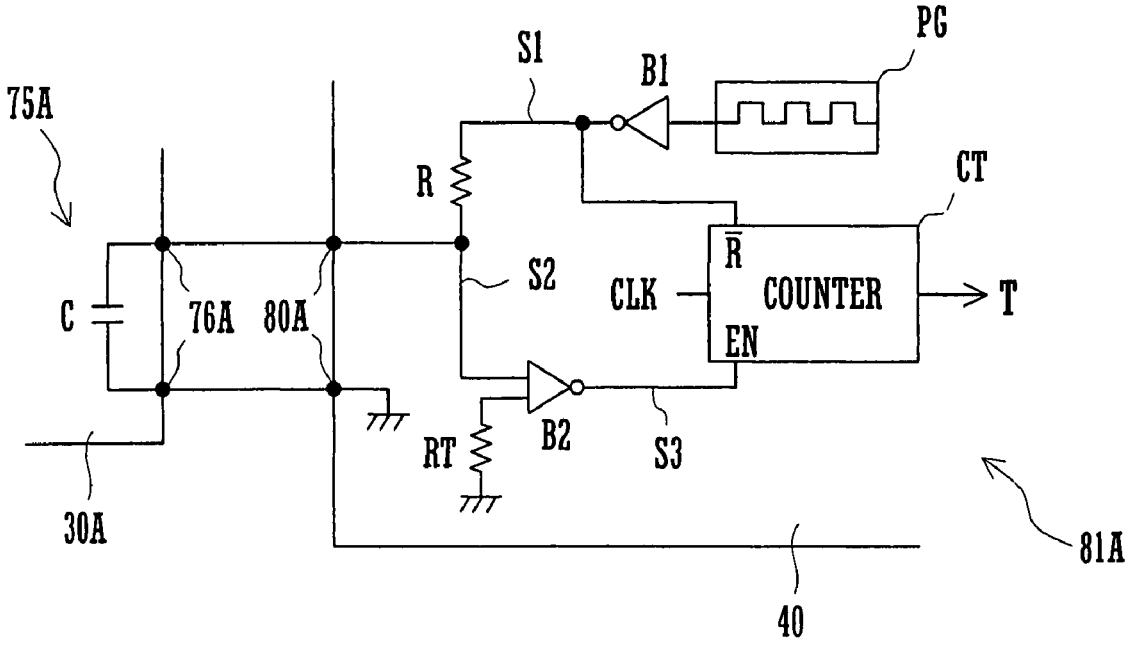
FIG. 3 is a specific circuit diagram including time constant circuit and identifier section.

FIG. 3 is a specific circuit diagram including time constant circuit 75A and identifier section 81A. In FIG. 3, the time constant circuit 75A comprises a capacitor C (circuit).

The image forming apparatus body 40 has resistance R to be connected to the aforementioned capacitor C in series. When connected to the capacitor C of the developer tank 30A in series, the resistance R forms a series CR time constant circuit. The identifier section 81A of the image forming apparatus body 40 includes a pulse generator PG for passing charging current through the series CR time constant circuit, a buffer B1 for feeding the series CR time constant circuit with pulses generated from the pulse generator PG, and resistance R inserted between an output terminal of the buffer B1 and the charging current outflow terminal 80A. The resistance R and the capacitor C form the series CR time constant circuit through which pulsed charging current passes.

The identifier section 81A includes, in addition to the aforementioned circuit, a comparator B2 for receiving differential inputs of a signal from a connection terminal between the resistance R and the capacitor C and a threshold voltage Vth, and a counter CT. The output of B2 is connected to the enable terminal (EN) of counter CT so that the counter CT is configured to count predetermined clocks CLK while the comparator B2 outputs. The output of B1 is connected to the reset terminal (R-bar) of counter CT so that the counter CT is reset when each of the pulse signals rises and counts a period of time for which the output of the comparator B2 is high (H). The comparator B2 has an input side connected to the connection terminal between the resistance R and the capacitor C and outputs a signal L (low) when the voltage across the opposite ends of capacitor C is higher than the threshold voltage Vth inputted through a reference resistance RT.

Figure 4:
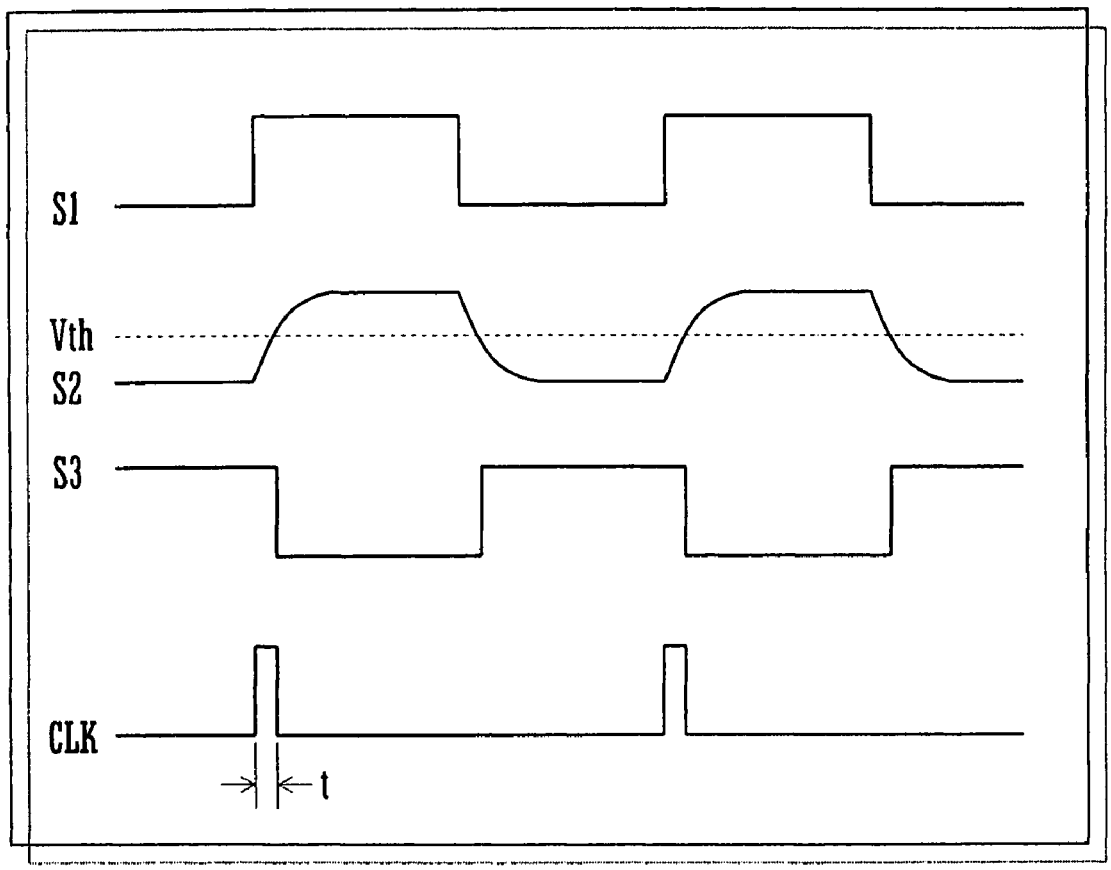
FIG. 4 is a circuit waveform diagram.

Thus, waveforms at respective portions in the above-described circuit configuration are as shown in FIG. 4. In FIG. 4, S1 represents an output waveform at the buffer B1, S2 represents an input waveform at the comparator B2, and S3 represents an output waveform at the comparator B2. The counter CT counts clocks CLK for a time period t, that is, a time period from a point in time at which S1 rises to a point in time at which S3 falls.

Figure 5:
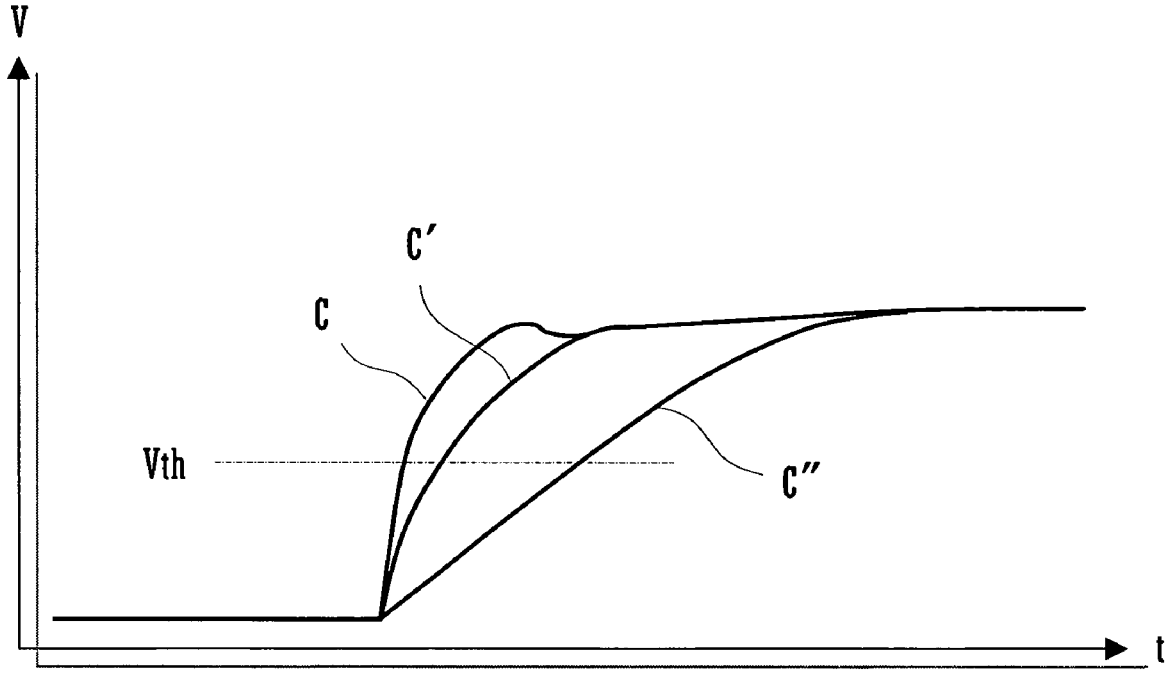
FIG. 5 is a diagram showing waveforms appearing during a transient phenomenon period during which a charging current passes.

With the above-described configuration, a change in waveform occurs in accordance with varying capacitance of the capacitor C of the developer tank 30A during a transient phenomenon period during which the charging current passes, as shown in FIG. 5. Accordingly, the value counted by the counter CT (counted value T) differs depending on the capacitance (C, C'or C") of capacitor C, or the type of developer tank 30A.

Since a non-illustrated control section included in the image forming apparatus body 40 can obtain the counted value, the image forming apparatus body 40 can determine whether or not the developer tank 30A fitted thereto is a correct one when the apparatus body 40 is informed of the counted value.

FIG. 6 shows types of capacitors C provided for developer tanks 30A to 30D. As shown, there are three types of image forming apparatus, namely, high-speed type apparatus, medium-speed type apparatus and low-speed type apparatus. If each type of image forming apparatus is fitted with developer tanks 30A to 30D containing K, Cy, M and Y toners, respectively, 12 types of capacitors Cl to C 12 are provided.

Figure 7:
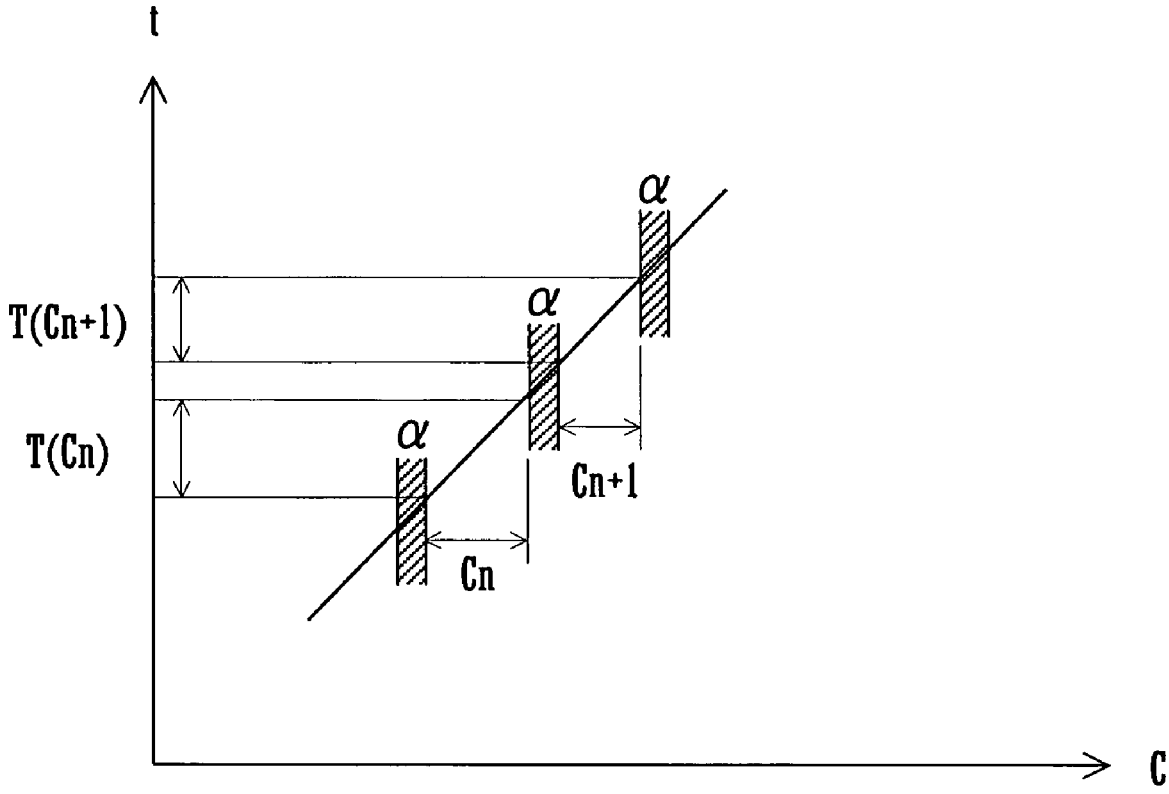
FIG. 7 is a graph showing a counted value T relative to the capacitance of capacitor C.

FIG. 7 is a graph showing counted values T each corresponding to a respective one of magnitudes of capacitance of capacitor C. Cn and Cn+1 each represent an allowable margin of capacitance and a forbidden zone a is provided between adjacent capacitors C. That is, if the counted value falls within the range of T(Cn), the capacitance of the capacitor C is determined as Cn. If the counted value falls within the range of T(Cn+1), the capacitance of the capacitor C is determined as Cn+1.

Since the time axis t in FIG. 7 can be sufficiently extended, the forbidden zone a can also be expanded. For this reason, even if the marked value of capacitance of each capacitor C has an error, it is possible to avoid erroneous identification. This results in improvements in developer tank identifying power and S/N.

Figure 8:
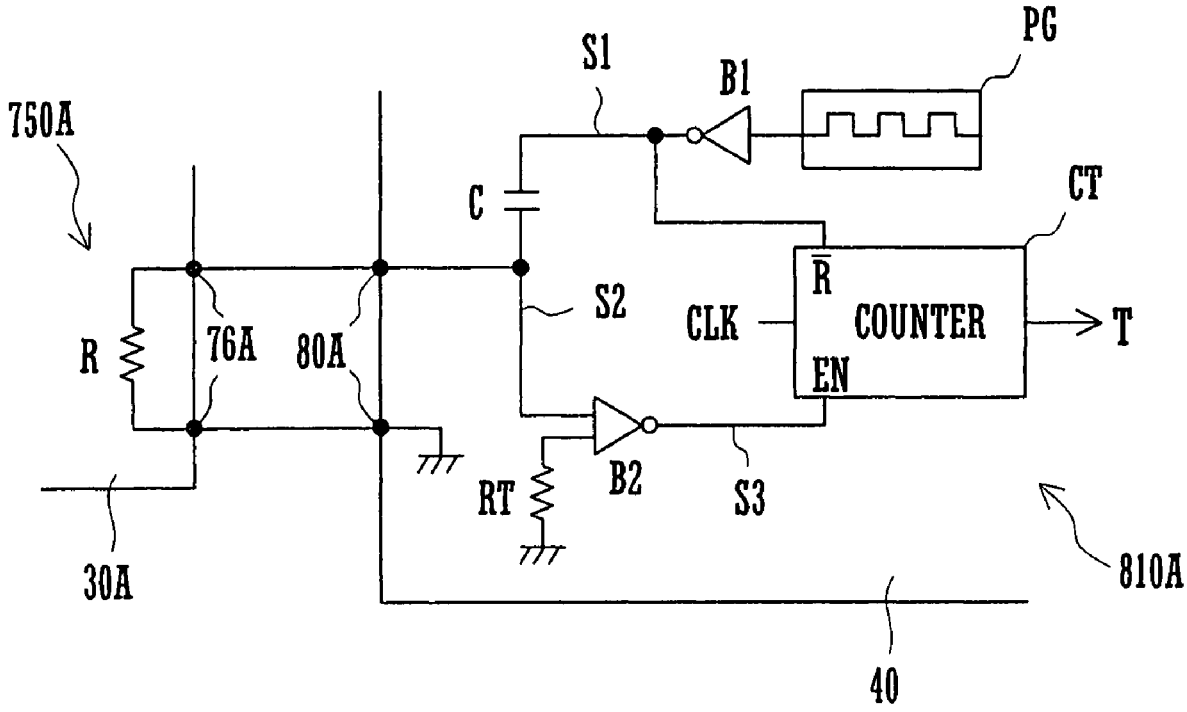
FIG. 8 is a partial circuit diagram of image forming apparatus according to a second embodiment of the present invention.

FIG. 8 is a partial circuit diagram of image forming apparatus A according to a second embodiment of the present invention. This configuration is different from that shown in FIG. 3 in that: developer tank 30A is provided with a time constant circuit 750A instead of the time constant circuit 75A used in the first embodiment; and image forming apparatus 40 includes an identifier section 810A instead of the identifier section 81A according to the first embodiment.

The time constant circuit 750A comprises resistance R instead of the capacitor C. The identifier section 810A includes capacitor C instead of the resistance R. Note that: there is a time constant circuit corresponding to each developer tank 30B to 30D. Each time constant circuit corresponding to each developer tank 30B to 30D has the same configuration as the time constant circuit 750A. There is also an identifier section corresponding to each developer tank 30B to 30D. Each identifier section corresponding to each developer tank 30B to 30D has the same configuration as the identifier section 810A.

This configuration according to the second embodiment can operate like the first embodiment and hence is capable of correctly identifying the developer tanks 30A to 30D fitted to the image forming apparatus A.

Figure 9:
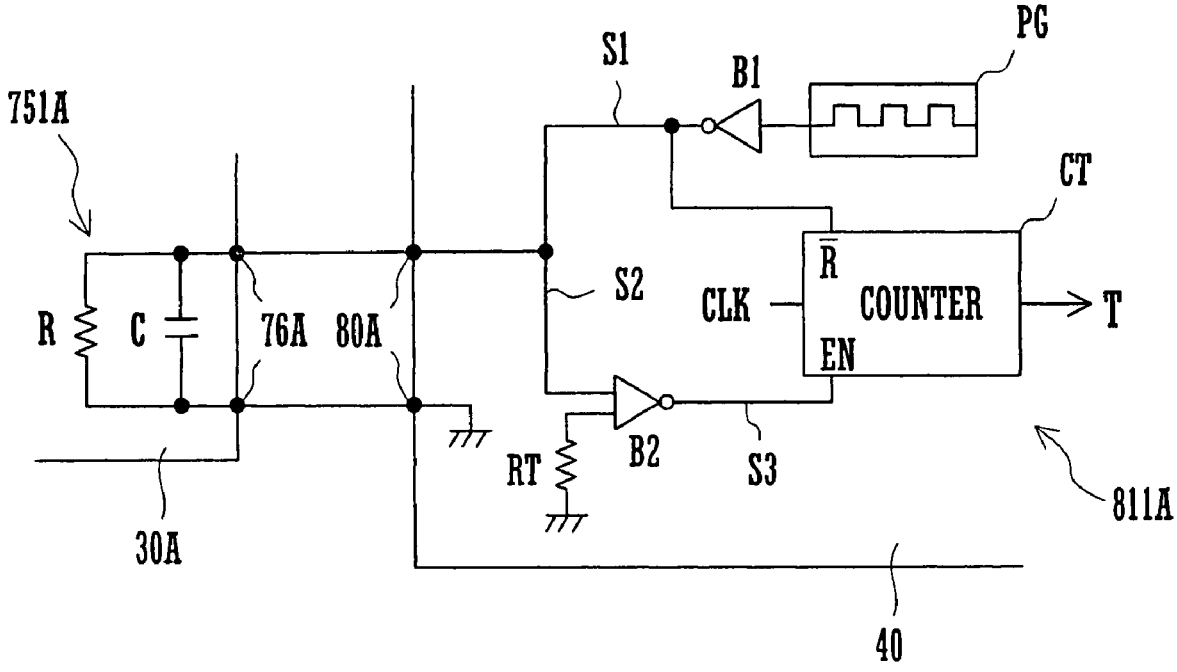
FIG. 9 is a partial circuit diagram of image forming apparatus according to a third embodiment of the present invention.

FIG. 9 is a partial circuit diagram of image forming apparatus A according to a third embodiment of the present invention. This configuration is different from that shown in FIG. 3 in that: developer tank 30A is provided with a time constant circuit 751A instead of the time constant circuit 75A used in the first embodiment; and image forming apparatus 40 includes an identifier section 811A instead of the identifier section 81A according to the first embodiment.

The time constant circuit 751A comprises resistance R and capacitor C connected in parallel. The identifier section 811A does not include resistance R. Note that: there is a time constant circuit corresponding to each developer tank 30B to 30D. Each time constant circuit corresponding to each developer tank 30B to 30D has the same configuration as the time constant circuit 751A. There is also an identifier section corresponding to each developer tank 30B to 30D. Each identifier section corresponding to each developer tank 30B to 30D has the same configuration as the identifier section 811A.

Accordingly, the developer tanks 30A to 30D are each provided with a parallel CR time constant circuit comprising capacitor C and resistance R. Though the behavior of charging current passing through each of the parallel CR time constant circuits when the developer tanks 30A to 30D become fitted is different from that of charging current passing through each of the series CR time constant circuits, the waveform appearing during a transient phenomenon period changes in accordance with the capacitance of capacitor C or the value of resistance R. Thus, the configuration according to the third embodiment can operate like the first and second embodiments and hence is capable of correctly identifying the developer tanks 30A to 30D fitted to the image forming apparatus A.

Figure 10:
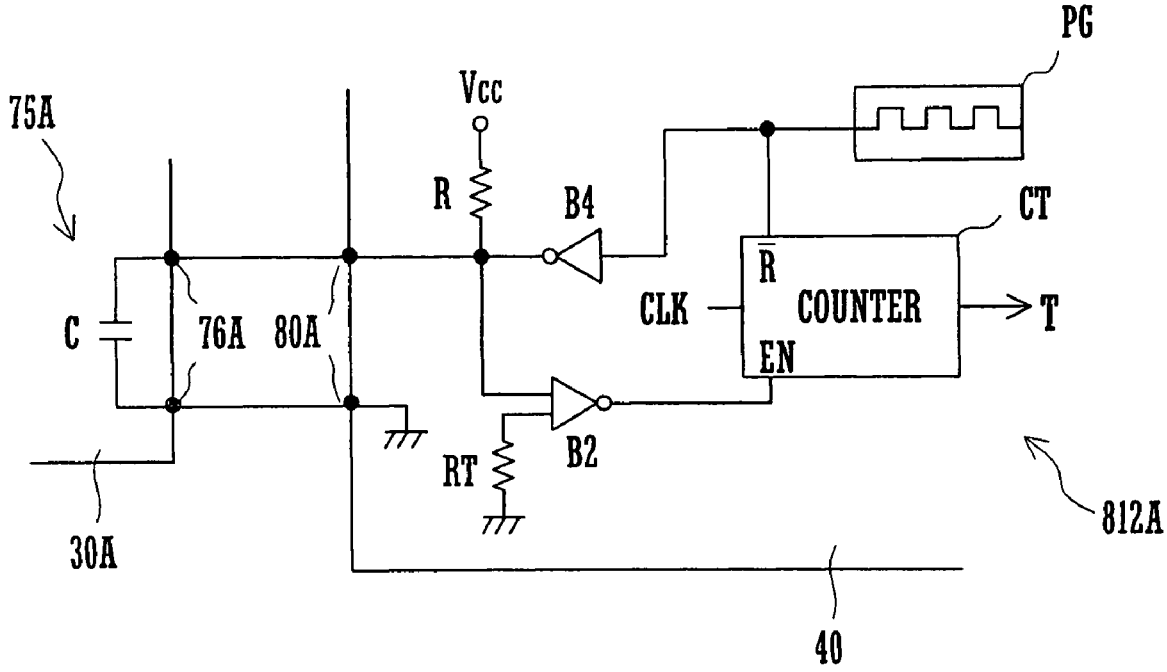
FIG. 10 is a partial circuit diagram of image forming apparatus according to a fourth embodiment of the present invention.

FIG. 10 is a partial circuit diagram of image forming apparatus A according to a fourth embodiment of the present invention. This configuration is different from that shown in FIG. 3 in that image forming apparatus body 40 includes an identifier section 812A instead of the identifier section 81A according to the first embodiment. In the identifier section 812A, an open collector buffer B4 is connected to the output side of pulse generator PG. Note that: there is an identifier section corresponding to each developer tank 30B to 30D. Each identifier section corresponding to each developer tank 30B to 30D has the same configuration as the identifier section 812A.

The use of the open collector buffer B4 allows charging current to directly pass through each of the series CR time constant circuits by bypassing the transistor of the buffer B4, thus ensuring more correct identification of the developer tanks 30A to 30D.

Figure 11:
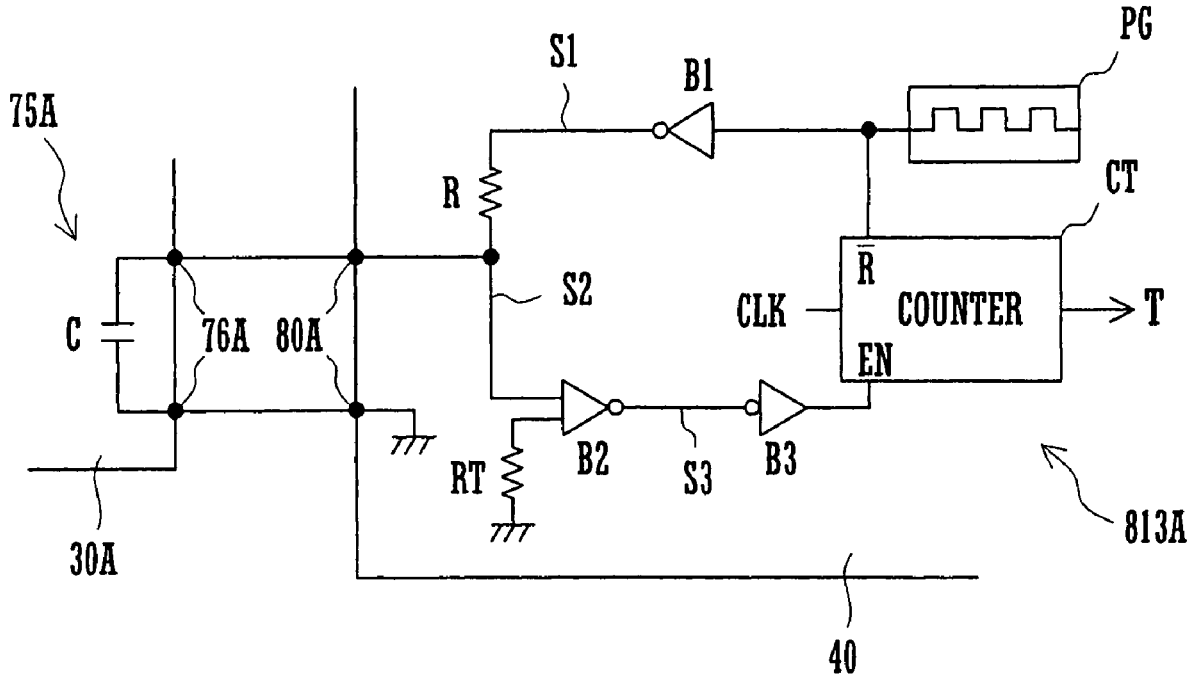
FIG. 11 is a partial circuit diagram of image forming apparatus according to a fifth embodiment of the present invention.
Figure 12:
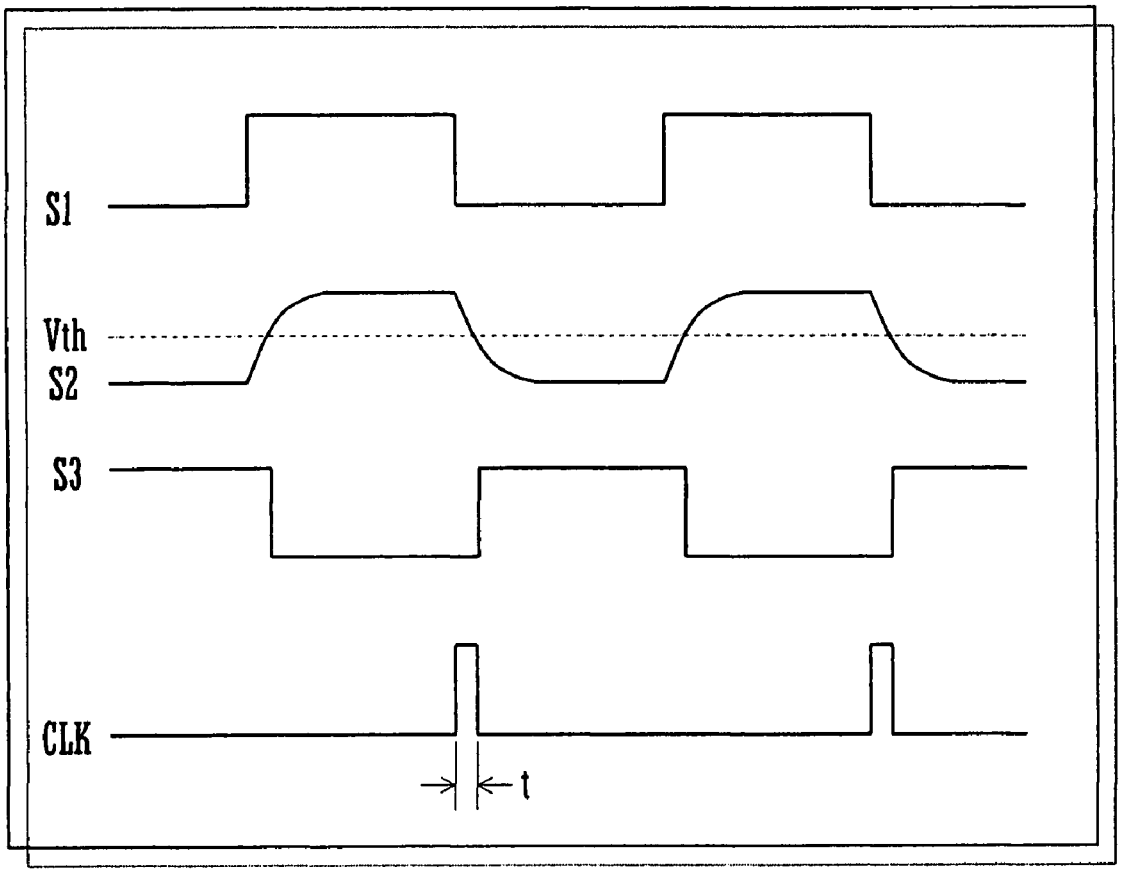
FIG. 12 is a circuit waveform diagram.

FIG. 11 is a partial circuit diagram of image forming apparatus A according to a fifth embodiment of the present invention. FIG. 12 is a waveform diagram of that circuit.

According to the first embodiment, the identifier section 81A passes charging current to the charging current outflow terminal 80A when the developer tank 30A is fitted to the image forming apparatus body 40 and identifies the developer tank 30A based on a change in waveform that occurs during a transient phenomenon period during which the charging current passes through the CR time constant circuit comprising capacitor C and resistance R. The above-described second to fourth embodiments operate like the first embodiment.

According to the fifth embodiment, in contrast, an identifier section 813A provided instead of the identifier section 81A of the first embodiment passes charging current to the charging current outflow terminal 80A when the developer tank 30A is fitted to the image forming apparatus body 40 and identifies the developer tank 30A based on a change in waveform that occurs during a transient phenomenon period following stopping of the charging current passing through the time constant circuit of the developer tank 30A.

In the identifier section 813A, the output of pulse generator PG is directly inputted to the reset terminal of counter CT and an inverter B3 is inserted between the enable terminal EN of counter CT and comparator B2, as shown in FIG. 11. With this configuration, waveforms result as shown in FIG. 12. Note: there is an identifier section corresponding to each developer tank 30B to 30D. Each identifier section corresponding to each developer tank 30B to 30D has the same configuration as the identifier section 813A.

The time constant circuit 75A provided for the developer tank 30A is not limited to the configuration shown in FIG. 11 but may have the configuration shown in FIG. 8 or 9.

While any one of the foregoing embodiments focuses attention on the voltage across the opposite ends of the time constant circuit comprising capacitor C or the like provided for each of developer tanks 30A to 30D and detects a change in the voltage that occurs during a transient phenomenon period, it is possible to detect a change in current that occurs during a transient phenomenon period.

The foregoing embodiments are illustrative in all points and should not be construed to limit the present invention. The scope of the present invention is defined not by the foregoing embodiment but by the following claims. Further, the scope of the present invention is intended to include all modifications within the meanings and scopes of claims and equivalents.

What is claimed is:

1. An image forming apparatus comprising an image forming apparatus body, and developer tanks to be removably fitted to the image forming apparatus body, the developer tanks each having a charging current inflow terminal which allows a charging current to flow in therefrom, and a time constant circuit which allows the charging current flowing in from the charging current inflow terminal to pass therethrough, the image forming apparatus body including a charging current outflow terminal to be connected to the charging current inflow terminal when an associated one of the developer tanks is fitted to the image forming apparatus body, and an identifier section configured to pass the charging current to the charging current outflow terminal when the associated developer tank is fitted to the image forming apparatus body and identify the developer tank based on a change in waveform that occurs during a transient phenomenon period during which the charging current passes through the time constant circuit of the developer tank.

2. The image forming apparatus according to claim 1, wherein the time constant circuits of respective of the developer tanks have different time constants depending on types of the developer tanks.

3. The image forming apparatus according to claim 1, wherein the time constant circuit comprises a capacitor circuit and the image forming apparatus body includes a resistance circuit to be connected to the capacitor circuit in series.

4. The image forming apparatus according to claim 1, wherein the time constant circuit comprises a resistance circuit and the image forming apparatus body includes a capacitor circuit to be connected to the resistance circuit in series.

5. The image forming apparatus according to claim 1, wherein the time constant circuit comprises a parallel circuit comprising a resistance circuit and a capacitor circuit.

6. The image forming apparatus according to claim 1., wherein the identifier section of the image forming apparatus body includes a counter section configured to compare a waveform appearing during the transient phenomenon period with a predetermined threshold value and count a period of time from a point in time at which the waveform rises to a point in time at which the waveform reaches the threshold value, the identifier section being configured to identify the developer tank based on the period of time counted by the counter section.

7. An image forming apparatus comprising an image forming apparatus body, and developer tanks to be removably fitted to the image forming apparatus body, the developer tanks each having a charging current inflow terminal which allows a charging current to flow in therefrom, and a time constant circuit which allows the charging current flowing in from the charging current inflow terminal to pass therethrough, the image forming apparatus body including a charging current outflow terminal to be connected to the charging current inflow terminal when an associated one of the developer tanks is fitted to the image forming apparatus body, and an identifier section configured to pass the charging current to the charging current outflow terminal when the associated developer tank is fitted to the image forming apparatus body and identify the developer tank based on a change in waveform that occurs during a transient phenomenon period following stopping of the charging current passing through the time constant circuit.

8. The image forming apparatus according to claim 7, wherein the time constant circuits of respective of the developer tanks have different time constants depending on types of the developer tanks.

9. The image forming apparatus according to claim 7, wherein the time constant circuit comprises a capacitor circuit and the image forming apparatus body includes a resistance circuit to be connected to the capacitor circuit in series.

10. The image forming apparatus according to claim 7, wherein the time constant circuit comprises a resistance circuit and the image forming apparatus body includes a capacitor circuit to be connected to the resistance circuit in series.

11. The image forming apparatus according to claim 7, wherein the time constant circuit comprises a parallel circuit comprising a resistance circuit and a capacitor circuit.

12. The image forming apparatus according to claim 11, wherein the identifier section of the image forming apparatus body includes a counter section configured to compare a waveform appearing during the transient phenomenon period with a predetermined threshold value and count a period of time from a point in time at which the waveform rises to a point in time at which the waveform reaches the threshold value, the identifier section being configured to identify the developer tank based on the period of time counted by the counter section.

13. A developer tank to be removably fitted to an image forming apparatus body, comprising:

a charging current inflow terminal which is connectable to a charging current outflow terminal when fitted to the image forming apparatus body; and a time constant circuit which allows a charging current from the charging current inflow terminal to pass therethrough and has a time constant predetermined depending on a type of a developer tank body.

14. The developer tank according to claim 13, wherein the time constant circuit comprises a capacitor circuit.

15. The developer tank according to claim 13, wherein the time constant circuit comprises a resistance circuit.

16. The developer tank according to claim 13, wherein the time constant circuit comprises a parallel circuit comprising a resistance circuit and a capacitor circuit.

17. A method of identifying a developer tank, comprising:

a step in which an identifier section included in an image forming apparatus body passes a charging current through a time constant circuit provided for the developer tank when the developer tank is fitted to the image forming apparatus body; and an identification step in which the identifier section identifies the developer tank based on a change in waveform that occurs during a transient phenomenon period during which the charging current passes through the time constant circuit.

18. A method of identifying a developer tank, comprising:

a step in which an identifier section included in an image forming apparatus body passes a charging current through a time constant circuit provided for the developer tank when the developer tank is fitted to the image forming apparatus body; and an identification step in which the identifier section identifies the developer tank based on a change in waveform that occurs during a transient phenomenon period following stopping of the charging current.

* * * * *